US008144019B2

(12) United States Patent
Ishizuka

(10) Patent No.: US 8,144,019 B2
(45) Date of Patent: Mar. 27, 2012

(54) IMAGE FORMING APPARATUS

(75) Inventor: Hisashi Ishizuka, Tokyo (JP)

(73) Assignee: Oki Data Corporation, Tokyo (JP)

( * ) Notice: Subject to any disclaimer, the term of this patent is extended or adjusted under 35 U.S.C. 154(b) by 635 days.

(21) Appl. No.: 12/347,000

(22) Filed: Dec. 31, 2008

(65) Prior Publication Data

US 2009/0184817 A1 Jul. 23, 2009

(30) Foreign Application Priority Data

Jan. 22, 2008 (JP) ..... 2008-011347

(51) Int. Cl.
*G08B 13/14* (2006.01)

(52) U.S. Cl. ..... 340/572.8; 340/10.51; 399/12

(58) Field of Classification Search ..... 340/10.1, 340/10.51, 572.1, 572.8; 358/1.15; 399/12
See application file for complete search history.

(56) References Cited

U.S. PATENT DOCUMENTS

2006/0216046 A1* 9/2006 Hatakeyama ..... 399/27
2007/0115340 A1* 5/2007 Tanabe ..... 347/130

FOREIGN PATENT DOCUMENTS

JP 2003271042 A * 9/2003
JP 2006-058743 A 3/2006
JP 2006-267528 A 10/2006

* cited by examiner

*Primary Examiner* — Thomas Mullen
(74) *Attorney, Agent, or Firm* — Panitch Schwarze Belisario & Nadel LLP

(57) ABSTRACT

An image forming apparatus is supplied capable of improving distance precision and relative position precision of a RFID tag and RFID unit so as to heighten communication quality of image forming apparatus. The image forming apparatus comprises attachable and removable image forming unit which has a RFID tag, and a RFID unit which is located in a LED head installing section and communicates with the RFID tag through radio communication, wherein the RFID tag is located on a side wall of the image forming unit and faces the RFID unit.

7 Claims, 10 Drawing Sheets

IMAGE FORMING APPARATUS

FIELD OF THE INVENTION

The invention relates to an image forming apparatus which can use a toner cartridge having RFID (Radio Frequency Identification) tag.

BACKGROUND OF THE INVENTION

In recent years, image forming apparatus is spread which can mount a toner cartridge having RFID tag and can manage toner remainder amount. In such conventional image forming apparatus, the RFID tag is furnished on the upper part of the toner cartridge, and a RFID antenna is furnished in a position which is on an upper cover of the image forming apparatus and faces to the RFID tag (refer to FIG. 6 of Patent Document 1). On the basis of such structure, the RFID tag and the RFID antenna communicate in radio form, and an management of toner remainder amount is executed.

Patent Document 1: Japan patent publication 2006-267528.

However, in such image forming apparatus, there is a problem, that is, because a distance precision or a relative position precision between the RFID tag and the RFID antenna is not achieved, communication error easily occurs. In particular, in such image forming apparatus comprising image forming units of four colors of Y (Yellow), M (Magenta), C (Cyan), K (Black), in the case to alternate color print and monochrome print, except the image forming unit of K color, the other image forming units of other three colors shift up and down, because of such repeated operations, it is difficult to keep precision of distance or relative position.

SUMMARY OF THE INVENTION

It is, therefore, an object of the invention to provide an image forming apparatus capable of solving the above problem.

An aspect of the invention is to provide an image forming apparatus including attachable and removable exchange cartridge which is used for accommodating toner and has a RFID tag, comprising:

exposure head unit that is furnished and located with respect to the exchange cartridge; and RFID unit that is furnished on the exposure head unit and performs radio communication with the RFID tag, wherein the RFID tag is furnished on side wall of the exchange cartridge and faces to the RFID unit.

Another aspect of the invention is to provide an image forming apparatus including attachable and removable exchange cartridge which is used for accommodating toner and has a RFID tag, comprising:

RFID unit that communicates with the RFID tag through radio communication, wherein the exchange cartridge is furnished as retreating in non-operational time; the exposure head unit is furnished movably; in the case that the exchange cartridge retreats, the exposure head unit moves together with the exchange cartridge.

The effect of the present invention:

According to the image forming apparatus of the invention, the exposure head unit and the exchange cartridge are located in exact positions, thus, vibration or warp of the exchange cartridge that is caused by rotation of photosensitive body drum is inhibited to a minimum. Therefore, it becomes easy to keep a distance precision and a relative position precision between the RFID tag and the RFID unit. As a result, it is possible to improve communication quality between the RFID tag and the RFID unit.

The above and other objects and features of the present invention will become apparent from the following detailed description and the appended claims with reference to the accompanying drawings.

DETAILED DESCRIPTION OF THE PREFERRED EMBODIMENTS

Embodiments of the invention will be described in detail hereinbelow with reference to the drawings.

<Embodiment 1>

Figure 1:
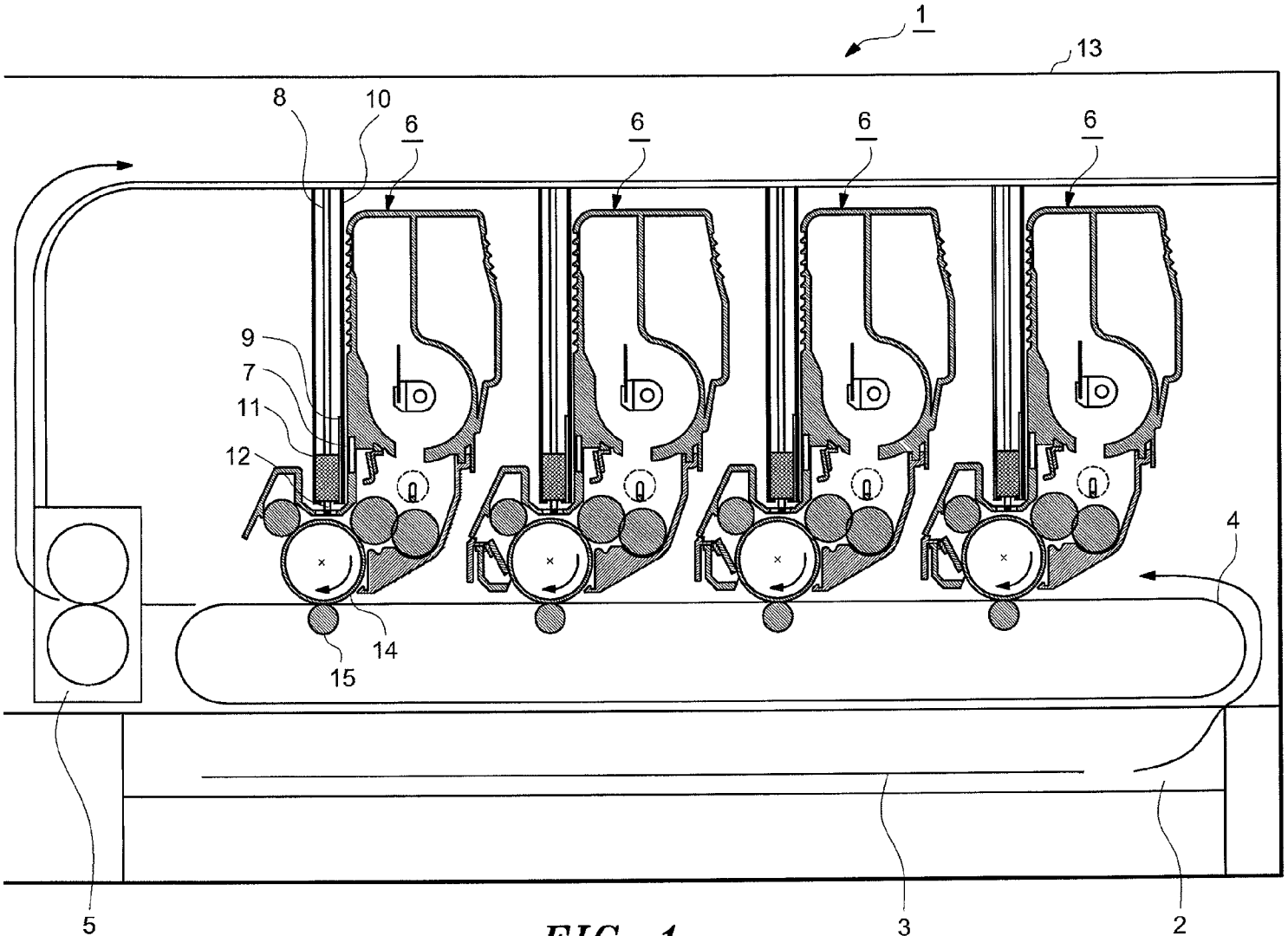
FIG. 1 is a diagram showing a summary structure of image forming apparatus of the present invention.

FIG. 1 is a diagram showing a summary structure of image forming apparatus of the present invention. The drawing is used to explain summary operation of image forming apparatus of the present invention.

Figure 2A:
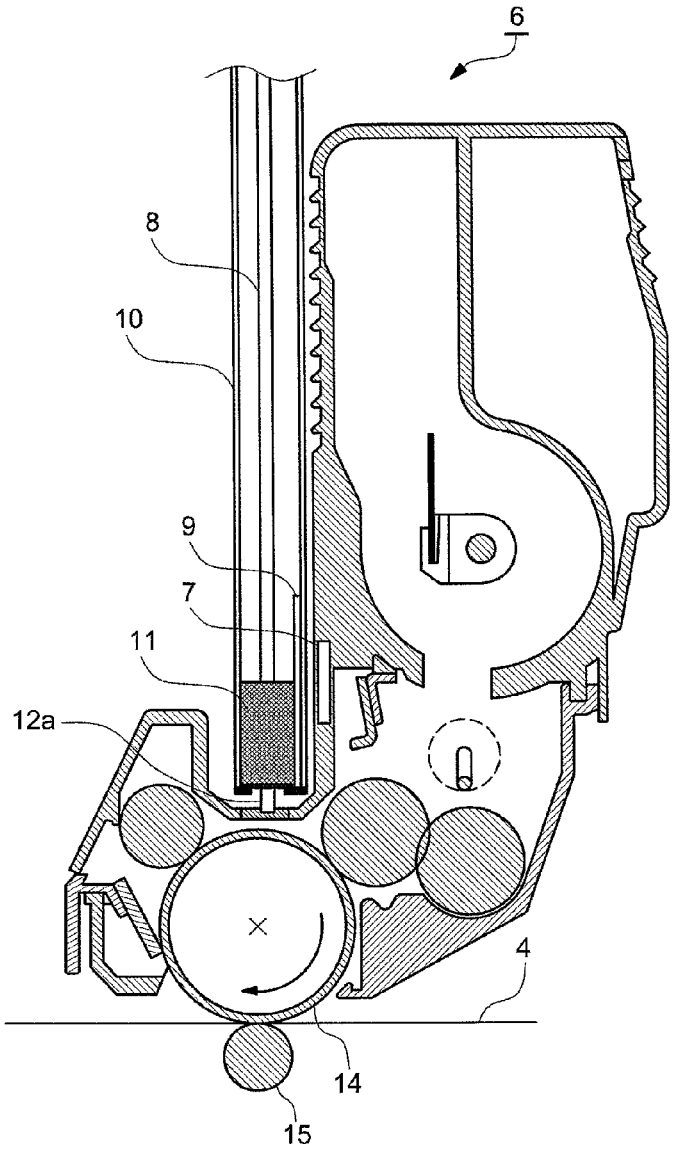
FIG. 2A is a diagram showing a structure of image forming unit.
Figure 2B:
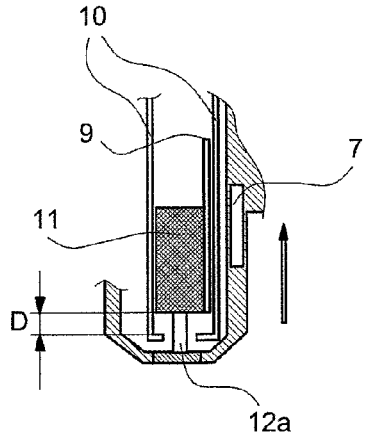
FIG. 2B is a diagram showing LED head and surrounding elements in FIG. 2A when image forming unit is lifted up.

FIG. 2A is a diagram showing a structure of image forming unit; and FIG. 2B is a diagram showing LED head and its circumference in FIG. 2A when image forming unit is lifted up. These drawings are used to explain detail structure of image forming apparatus of the present invention.

The following is to explain summary operation and structure of image forming apparatus of the present invention while referring to these drawings.

An image forming apparatus 1 of the present invention is a color printer as an example, it comprises four sets of image forming units 6 that can respectively form toner images of four colors of Y (Yellow), M (Magenta), C (Cyan), K (Black) and transfer the toner images onto paper. Each image forming unit 6 is movably attached to the image forming apparatus 1.

Paper 3 set on paper tray 2 is fed to a belt unit 4 through paper feeding roller (not shown). The belt unit 4 conveys the paper 3 to a fixing unit 5. Toner images that are formed in accumulative layers on the conveyance in image forming units 6 of four colors of Y (Yellow), M (Magenta), C (Cyan), K (Black), are respectively transferred onto the paper 3 by transferring rollers 15. The toner images transferred on the paper 3 are fixed on the paper 3 through the fixing unit 5 heats to high temperature, and the paper 3 is ejected.

As shown by these drawings, in the image forming unit 6 of the present invention, a RFID tag 7 is furnished inside the image forming unit 6 and is placed on 2 5 the side wall of the image forming unit 6 so as to obtain a structure preventing the RFID tag 7 from being easily taken out. The RFID tag 7 is a semiconductor element that has a memory area into which information such as inherent tag number, accumulation rotation number of photosensitive body drum 14, toner remainder amount calculated on the basis of the accumulation rotation number, or the like is written. Moreover, the image forming unit 6 may include a removable and attachable toner cartridge to accommodate toner, as exchange cartridge. Then, the RFID tag 7 may furnished inside the exchange cartridge.

A RFID unit 9 includes a transmitting and receiving circuit and a transmitting and receiving antenna (described below), and can communicate with the RFID tag 7. The RFID unit 9 is furnished in a position which is on the side surface of a LED head installing section 10 and is facing the RFID tag 7. The RFID tag 7 and the RFID unit 9 communicate through radio, and perform operations to write or read the information stated above, so that management or the like of toner remainder amount is executed.

The LED head installing section 10 is an outer frame to support a LED head 11 in slidable state. The LED head installing section 10 is fixed on an upper cover 13. Thereby, when opening or shutting the upper cover 13, the LED head installing section 10 moves up and down together with the upper cover 13. Regarding these operations, that will be explained again by using other drawings.

As stated above, in the present invention, the RFID tag 7 is furnished inside the image forming unit 6 and is placed on the side wall of the image forming unit 6 so that it could not be easily taken out, the RFID unit 9 is furnished in a position which is on the side surface of the LED head installing section 10 and is facing the RFID tag 7. Here, a position relation of the LED head installing section 10 and the image forming unit 6 is carefully set in order to improve print precision.

Therefore, through furnishing the RFID tag 7 inside the image forming unit 6 and placing the RFID tag 7 on the side wall of the image forming unit 6; and through furnishing the RFID unit 9 in a position which is on the side surface of the LED head installing section 10 and is facing the RFID tag 7, it is possible to easily achieve a distance precision and a relative position precision between the RFID tag 7 and the RFID unit 9. Through improving the distance precision and the precision of relative position between the RFID tag 7 and the RFID unit 9, the radio communication quality between the RFID tag 7 and the RFID unit 9 can be heightened.

Here, as a structure used to exactly keep intact the positional relationship of the LED head 11 and the image forming unit 6, a structure and function of a position deciding post 12 is explained by using drawings including other drawings.

Figure 3A:
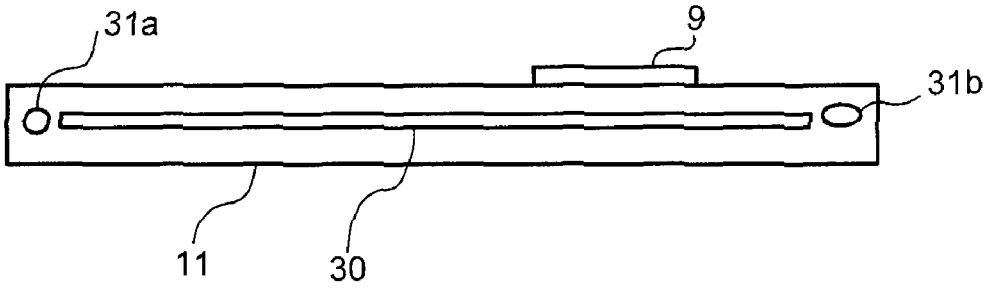
FIG. 3A is a bottom view showing LED head and surrounding elements.
Figure 3B:
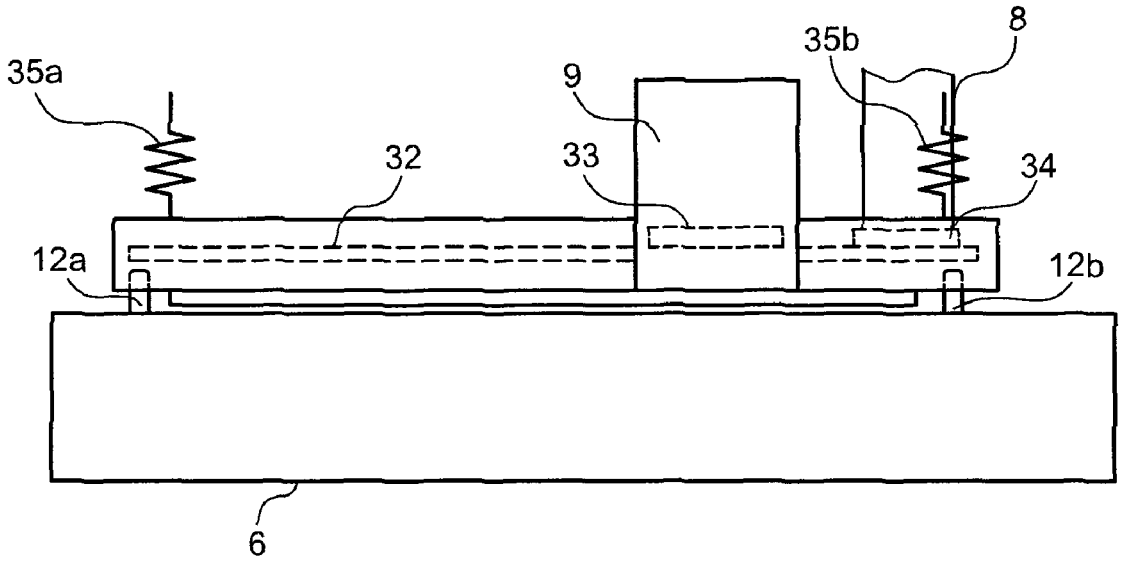
FIG. 3B is a side view showing LED head and surrounding elements.

FIG. 3A is a bottom view showing LED head and its circumference; and FIG. 3B is a side view showing LED head and its circumference.

As shown by FIG. 3A, a bottom plane is shown where the LED head 11 faces the photosensitive body drum 14 of the image forming unit 6. In the LED head 11, a lens array 30 is composed of plural LEDs to correspond to the LED dots in main movement direction. On the two sides of the lens array 30, a circle hole 31*a* and a circle hole 31*b* are furnished.

As shown by FIG. 3B, the upper cover 13 (FIG. 1) is shut, a position deciding post 12*a* is fit into the circle hole 31*a*, and a position deciding post 12*b* is fit into the circle hole 31*b*; the LED head 11 is fit to the image forming unit 6. When the upper cover 13 is completely shut, a spring 35*a* and a spring 35*b* use elastic pressure to fix the LED head 11 to the image forming unit 6 (FIG. 2). The spring 35*a* and the spring 35*b* are pressed by bracket (not shown) furnished on the LED head installing section 10. Thus, the LED head 11 is placed in an exact positions. Moreover, the LED head 11 is furnished to be shiftable with respect to the LED head installing section 10 via the spring 35*a* and the spring 35*b*.

Further, as stated above, in such image forming apparatus comprising image forming units of four colors of Y (Yellow), M (Magenta), C (Cyan), K (Black), in order to alternate color print and monochrome print, using just the K color, the other image forming units of other three colors are lifted up or lifted down. However, in the case, as shown by FIG. 2B, because the LED head 11 is shiftable with respect to the LED head installing section 10, so the LED head 11 shifts up or shifts down together with the image forming unit 6. That is, as shown by FIG. 2B, the LED head 11 can move in the LED head installing section 10, when the image forming unit 6 is lifted up by a movement amount "D", the LED head 11 is still in an intact position with respect to the image forming unit 6 through the position deciding post 12*a* and the position deciding post 12*b*. Therefore, in fact, the LED head 11 is also lifted up together with the image forming unit 6. Moreover, because the LED head installing section 10 is fixed on the upper cover 13 at the side of printer body, the LED head installing section 10 is not lifted up.

Therefore, a position relation of the LED head 11 and the image forming unit 6 is exactly kept.

As shown by FIG. 3B, there are a LED head substrate 32, a connector 33 and a connector 34.

The connector 33 is soldered on the LED head substrate 32 and loads the RFID unit 9 on the LED head substrate 32. The RFID unit 9 is placed in an exact position through installing the connector 33. However, it is also possible to install the RFID unit 9 on the side wall of the LED head installing section 10 (FIG. 2) and to connect the RFID unit 9 with the LED head substrate 32 via a conductor and the like without using the connector 33.

The connector 34 is used for connecting the LED head substrate 32 with a LED head cable 8 and is soldered on the LED head substrate 32. Through the LED head cable 8, bit information of the LED head 11 and information written into the RFID tag 7 or read out from the RFID tag 7 can be sent or received.

As explained above, the LED head 11 is placed in an exact position so that a positional relationship of the LED head 11 and the image forming unit 6 is kept exactly. Therefore, in the case to lift up/down the image forming units of other three colors except the image forming unit of K color when alternating color print and monochrome print, even if the photosensitive body drum 14 is rotating, it is possible to keep vibration or warping of the image forming unit 6 to a minimum. That is, a better distance precision and a better relative position precision of the RFID tag 7 and the RFID unit 9 can be easily obtained.

As shown by FIG. 1 and FIG. 2A, the LED head 11 is a part to receive dot signal from an apparatus located above the LED head 11 and emit light onto surface of the photosensitive body drum 14 so as to form an electrostatic latent image. The upper cover 13 is an apparatus cover of the image forming apparatus 1 on top, and it is opened and shut when exchanging the image forming unit 6. On the upper cover 13, the LED head installing section 10 is fixed. When opening or shutting the upper cover 13, the upper cover 13 and the LED head installing section 10 move up and down together. Regarding the function, it will be explained again by using drawing.

Figure 4:
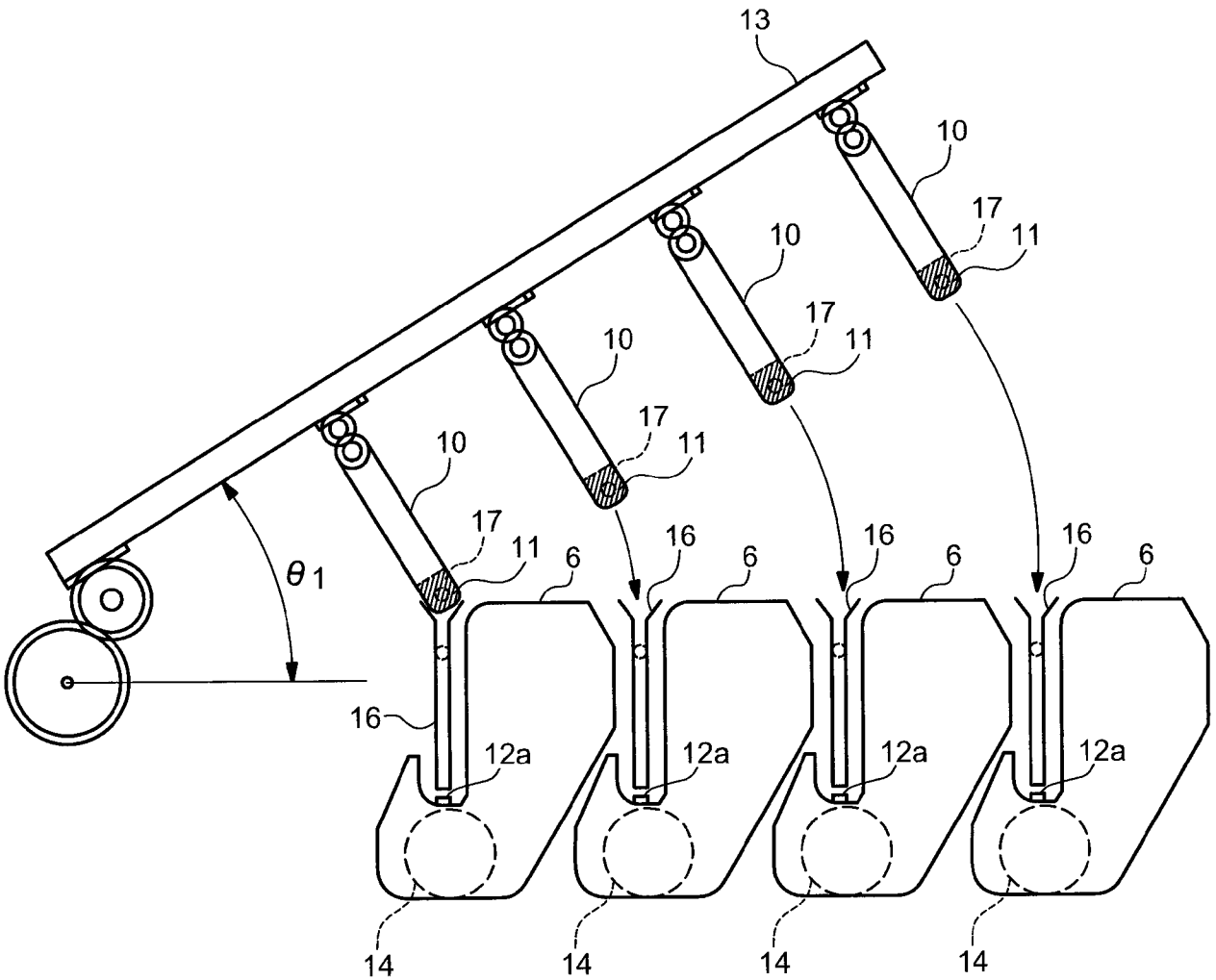
FIG. 4 is a diagram for explaining opening and shutting operations of upper cover.

FIG. 4 is a diagram for explaining opening and shutting operations of upper cover.

FIG. 4 shows a state that the upper cover 13 and the LED head installing section 10 operate together when exchanging the image forming unit 6 or the like. As shown by FIG. 4, the upper cover 13 is opened to rotate an angle of $\theta_1$ degrees when exchanging the image forming unit 6. At that time, the LED head 11 is separated from the position deciding post 12*a*. Further, when the upper cover 13 is shut again, the LED head 11 is fitted to the position deciding post 12*a* so as to be located, and, a guide pin 17 furnished on the side surface (it corresponds to back side in FIG. 4) of the LED head installing section 10 is guided to a predetermined position by a position deciding guide 16 formed on the side surface (it corresponds to front side in FIG. 4) of a case outer frame (not shown).

Next, a controlling system of the image forming apparatus 1 is explained.

Figure 5:
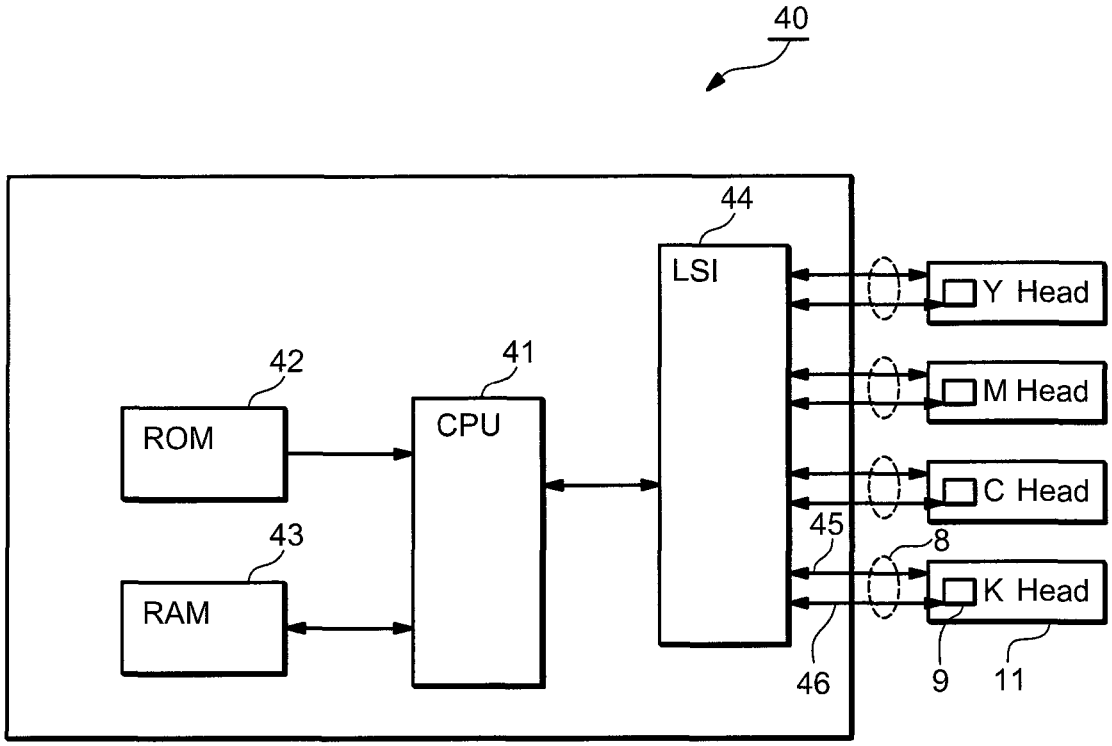
FIG. 5 is a block diagram of controlling system of image forming apparatus in embodiment 1.

FIG. 5 is a block diagram of controlling system of image forming apparatus in embodiment 1.

As shown by FIG. 5, a controlling system 40 of the image forming apparatus 1 in the embodiment 1 includes a CPU 41, a ROM 42, a RAM 43 and a LSI 44.

The CPU 41 is a central processing unit to control image data process and the whole apparatus, as a central calculating control element, through executing control program previously stored in the ROM 42. The ROM 42 is a read only memory to previously store control program executed by the CPU 41 for controlling image data process and the whole apparatus.

The RAM 43 is a random access memory to necessary calculation area when the CPU 41 executes the control program previously store in the ROM 42 to control image data process and the whole apparatus.

The LSI 44 is a large scale integrated circuit needed for signal processing when the CPU 41 communicates with the LED head 11 and the RFID unit 9. A LED head cable 8 contains a cable 45 to connect the LSI 44 to the LED head 11; and a cable 46 to connect the LSI 44 to the RFID unit 9. Both the cable 45 and the cable 46 are connected with the image forming units 6 of four colors of Y (Yellow), M (Magenta), C (Cyan), K (Black), as a pair of cables.

Figure 6:
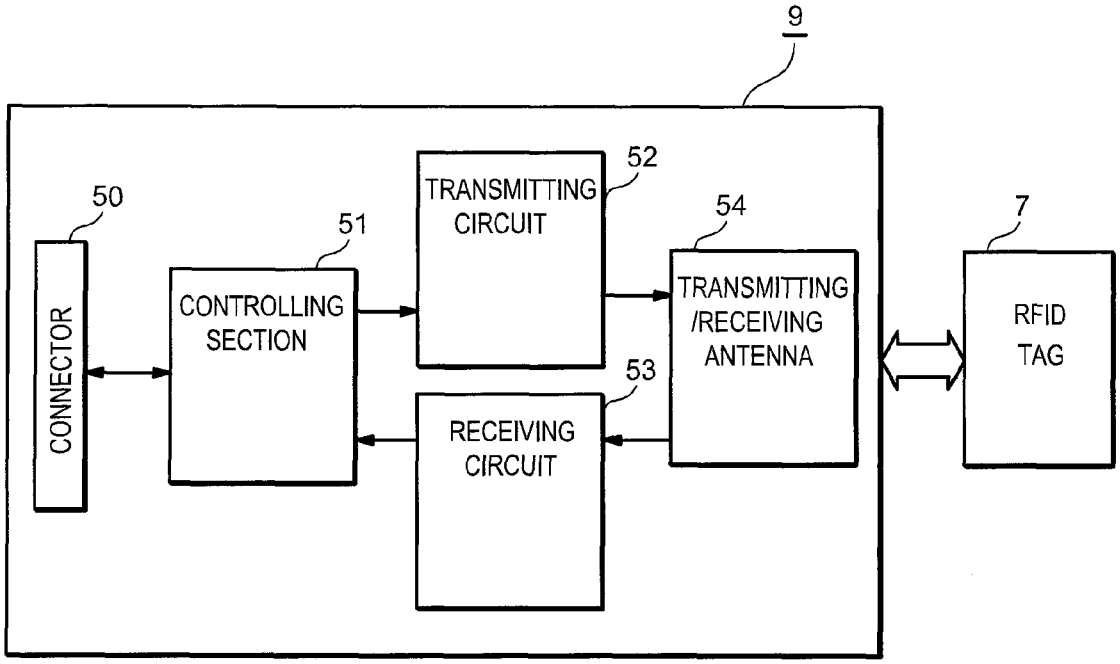
FIG. 6 is a function block diagram of RFID unit.

FIG. 6 is a function block diagram of RFID unit.

As shown by FIG. 6, the RFID unit 9 includes a connector 50, a controlling section 51, a transmitting circuit 52, a receiving circuit 53 and a transmitting/receiving antenna 54.

The connector 50 is a connector to connect the RFID unit 9 to the LED head 11 (FIG. 5). The controlling section 51 controls the whole RFID unit 9. The transmitting circuit 52 is a circuit to generate transmission signal such as for writing information to the RFID tag 7 and the like on the basis of the control of the controlling section 51. Further, the transmitting circuit 52 also is a signal modulating circuit for radioing the transmission signal via the transmitting/receiving antenna 54.

The receiving circuit 53 is a circuit to receive receiving signal from the RFID tag 7 via the transmitting/receiving antenna 54 on the basis of the control of the controlling section 51. Further, the receiving circuit 53 also is a circuit to demodulate the receiving signal so as to obtain reading information from the RFID tag 7 and the like.

The transmitting/receiving antenna 54 is a radio antenna for radio communication with the RFID tag 7. Through the transmitting/receiving antenna 54, information from the RFID tag 7 can be received and information to be written to the RFID tag 7 can be transmitted.

The RFID unit 9 performs the following operations.

Figure 7:
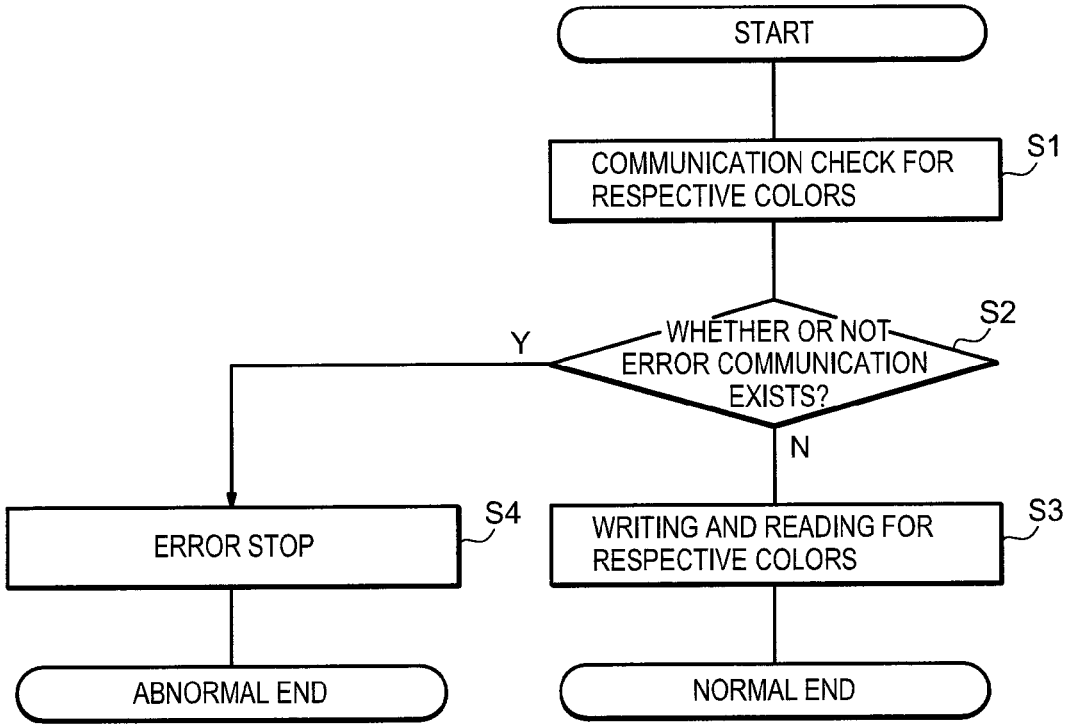
FIG. 7 is a flowchart for explaining operation of RFID unit.

FIG. 7 is a flowchart for explaining operation of RFID unit.

The following is to perform an explanation according to an order from step S1 to step S4 in the flowchart of FIG. 7, together with FIGS. 5 and 6.

Step S1:

On the basis of a control of the controlling system 40 of the image forming apparatus 1, the controlling section 51 performs a radio communication with the respective RFID tags 7 in the image forming units 6 of four colors of Y (Yellow), M (Magenta), C (Cyan), K (Black); and checks whether or not abnormality occurs in communication.

Step S2:

In the case that the controlling section 51 detected an error communication in the communication with any of the RFID tags 7 in the image forming units 6 of four colors of Y (Yellow), M (Magenta), C (Cyan), K (Black), the controlling section 51 executes step S4; in the case that an error is not detected from any of the image forming units 6, the controlling section 51 executes step S3.

Step S3:

Because the controlling section 51 judges that error does not exist in any of the image forming units 6 of four colors of Y (Yellow), M (Magenta), C (Cyan), K (Black), when power source is turned on, the controlling section 51 reads information of the RFID tags 7 of respective colors; when executing print, the controlling section 51 writes toner use amounts (according to rotation number of the photosensitive body drum 14) in the respective image forming units 6 (FIG. 1) into the RFID tags 7, as consumption part life information; and notifies the controlling system 40 of the image forming apparatus 1 of the consumption part life information. Then, the controlling section 51 normally ends the flow on the basis of the control of the controlling system 40 of the image forming apparatus 1.

Step S4:

Because the controlling section 51 judges that error exists in one of the image forming units 6 of four colors of Y (Yellow), M (Magenta), C (Cyan), K (Black), the controlling section 51 notifies the controlling system 40 of the image forming apparatus 1 of such case. The controlling system 40 of the image forming apparatus 1 displays the error on an operation panel (not shown). Then, the controlling section 51 abnormally ends the flow on the basis of the control of the controlling system 40 of the image forming apparatus 1.

As explained above, according to the embodiment, the RFID tag 7 is furnished on the side wall inside the image forming unit 6 and the RFID unit 9 is furnished in a position on the side plane of the LED head installing section 10 as facing the RFID tag 7, therefore, it is possible to easily achieve a distance precision and a relative position precision of the RFID tag and the RFID antenna.

Further, since the LED head 11 and the image forming unit 6 are properly positioned, vibration or warping of the image forming unit 6 that is caused by rotation of photosensitive body drum is kept to a minimum. Therefore, it becomes easy to keep a distance precision and a relative position precision between the RFID tag 7 and the RFID unit 9.

Moreover, because the LED head installing section 10, the LED head 11 and the image forming unit 6 are properly positioned, in the case that the image forming unit 6 is not correctly set when opening or shutting the upper cover 13, when changing color print to monochrome print or changing monochrome print to color print, even if lifting up or lifting down the image forming unit 6, it is possible 2 0 to prevent degradation of precision of distance or relative position of the RFID tag 7 and the RFID unit 9 from occurring.

Furthermore, because the precision of distance or relative position of the RFID tag 7 and the RFID unit 9 is improved and kept, it is possible to heighten radio communication quality between the RFID tag 7 and the RFID unit 9.

<Embodiment 2>

In the embodiment 1, the LED head cable 8, as shown by FIG. 5, includes two kinds of communication lines of the cable 45 to connect the LSI 44 to the LED head 11; and the cable 46 to connect the LSI 44 to the RFID unit 9. In the embodiment 2, a cable is used in common for two kinds of signal lines. In order to realize such objective, a controlling system of image forming apparatus in the embodiment is formed as follows.

Figure 8:
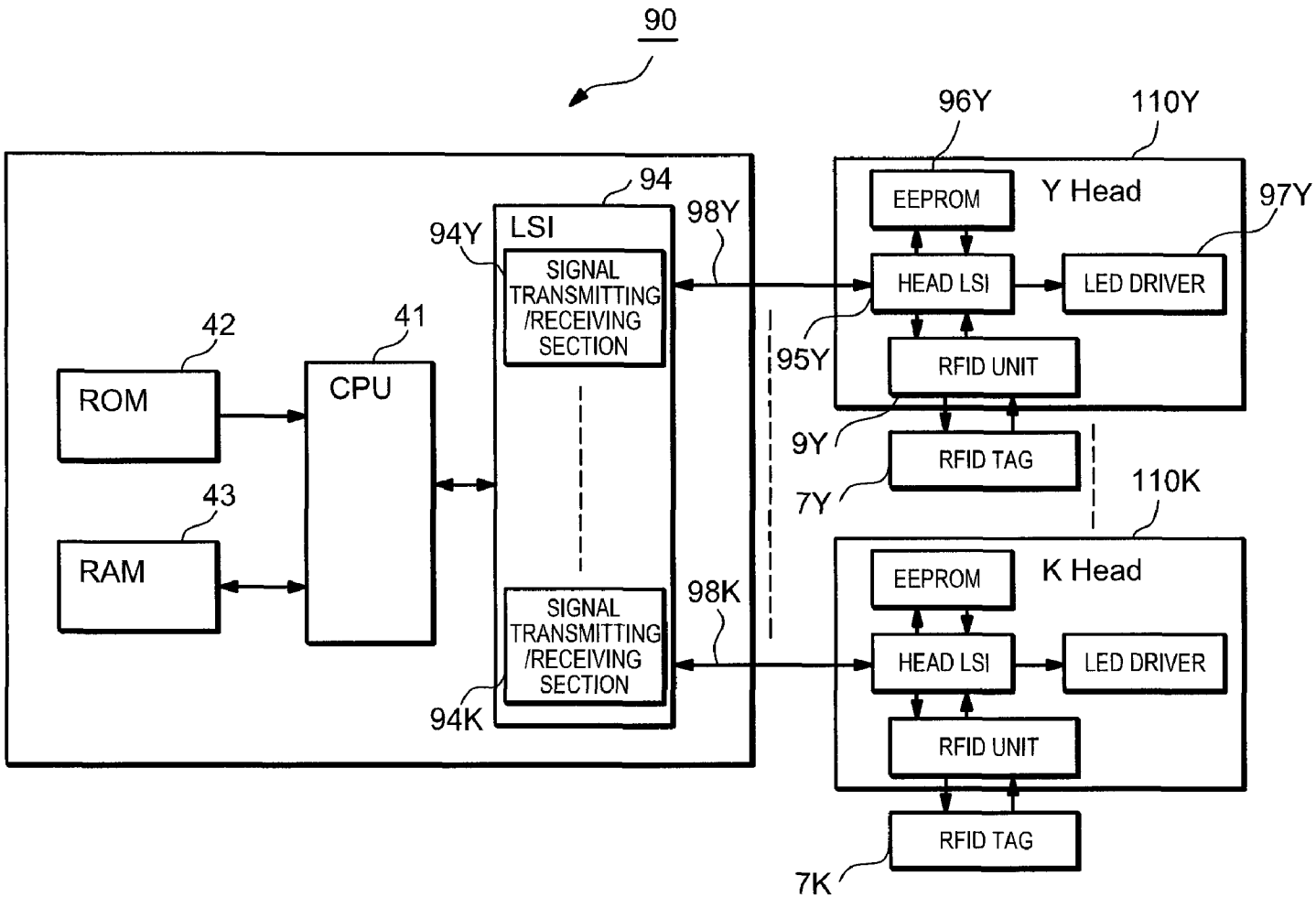
FIG. 8 is a block diagram of controlling system of image forming apparatus in embodiment 2.

FIG. 8 is a block diagram of controlling system of image forming apparatus in embodiment 2.

As shown by FIG. 8, a controlling system 90 of image forming apparatus of the embodiment 2 includes a CPU 41, a ROM 42, a RAM 43 and a LSI 94. The following is only to explain component different from the embodiment 1. Regarding some same component as the embodiment 1, same symbol is assigned, and its explanation is omitted.

The CPU 41 is a central processing unit to control image data process and the whole apparatus, as a central calculating control element, through executing control program previously stored in the ROM 42. The ROM 42 is a read only memory to previously store control program executed by the CPU 41 for controlling image data process and the whole apparatus.

The RAM 43 is a random access memory to necessary calculation area when the CPU 41 executes the control program previously store in the ROM 42 to control image data process and the whole apparatus.

The LSI 94 is a large scale integration circuit that includes a signal transmitting/receiving section 94Y and is needed for the CPU 41 to communicate with the LED head 110Y (it contains the RFID unit 9). In the embodiment, though various components are used for four colors of Y (Yellow), M (Magenta), C (Cyan), K (Black), because they have the same structure, only structure for Y color will be explained.

The signal transmitting/receiving section 94Y is a part to identify transmission signal and receiving signal between the CPU 41 and the LED head 110Y and interface them. A LED head cable 98Y is a communication line used for connecting the LSI 94 to the LED head 110Y and used in common for transmitting and receiving.

Further, as shown by FIG. 8, the LED head 110Y of the image forming apparatus in embodiment 2 includes a RFID unit 9Y, a Head LSI 95Y, an EEPROM 96Y, and a LED Driver 97Y.

The EEPROM 96Y is a read only memory to store previous dot correction signals of the LED head 110Y. The RFID unit 9Y, as in the embodiment 1, is a unit which has a transmitting/receiving circuit and a transmitting/receiving antenna; and can communicate with the RFID tag 7.

The Head LSI 95Y is a part to analyze command of signal between the controlling system 90 and the LED head 110Y; and control a conflict prevention of signal (that is, to prevent a conflict in timings of respective signals from occurring) among the EEPROM 96Y, the RFID unit 9Y and the LED Driver 97Y. Regarding the control content, it will be explained below. The following is to explain an internal structure of the Head LSI 95Y.

Figure 9:
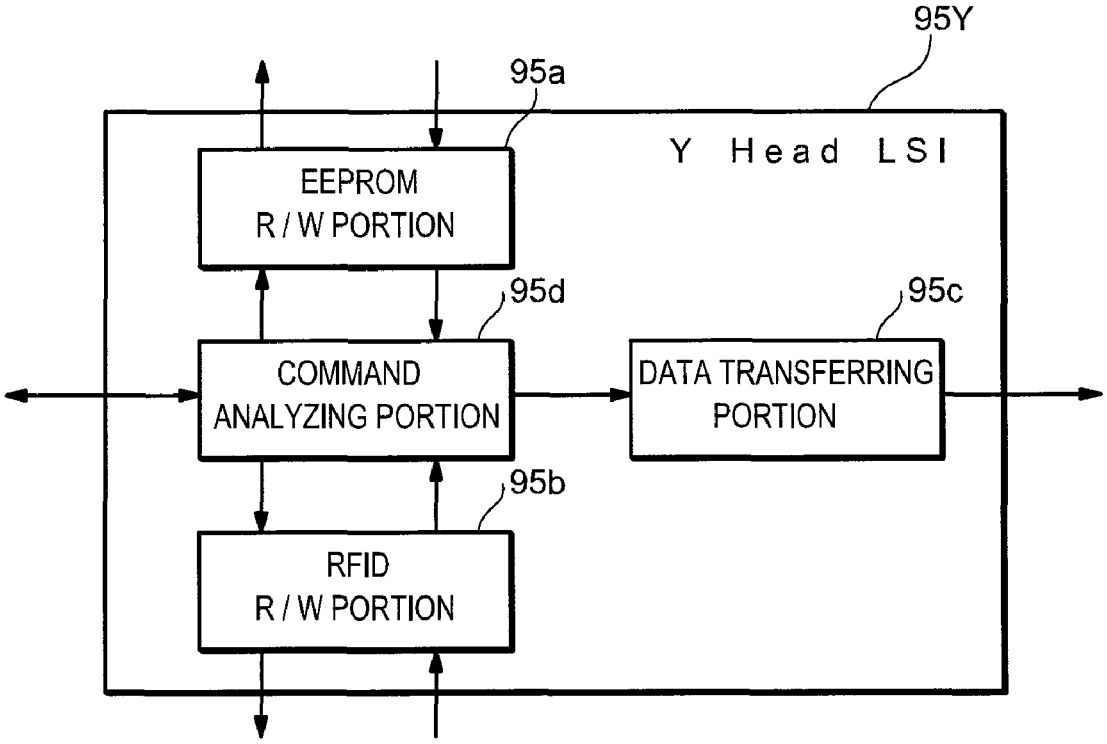
FIG. 9 is a block diagram of Head LSI.

FIG. 9 is a block diagram of Head LSI.

As shown by FIG. 9, the Head LSI 95Y has an EEPROM R/W portion 95*a*; a RFID R/W portion 95*b*; a data transferring portion 95*c*; and a command analyzing portion 95*d*.

The EEPROM R/W portion 95*a* is a part to read out dot correction information from the EEPROM 96Y (FIG. 8) on the basis of a control of the command analyzing portion 95*d*.

The RFID R/W portion 95*b* is a part to connect with the RFID unit 9Y (FIG. 8) on the basis of a control of the command analyzing portion 95*d* for executing transmission and receiving of consumption part life information and the like with the RFID tag 7Y.

The data transferring portion 95*c* is a part to send dot data to the lens array 30 (FIG. 3) on the basis of a control of the command analyzing portion 95*d* for making LED emit light to correspond to dot.

The command analyzing portion 95*d* is a part to analyze command of signal between the controlling system 90 and the LED head 110Y; and control a conflict prevention of signals among the EEPROM 96Y, the RFID unit 9Y and the LED Driver 97Y. Regarding the control content, it will be explained below.

The following is to explain control method of image forming apparatus of embodiment 2 around operations of the Head LSI through using a time chart.

Figure 10:
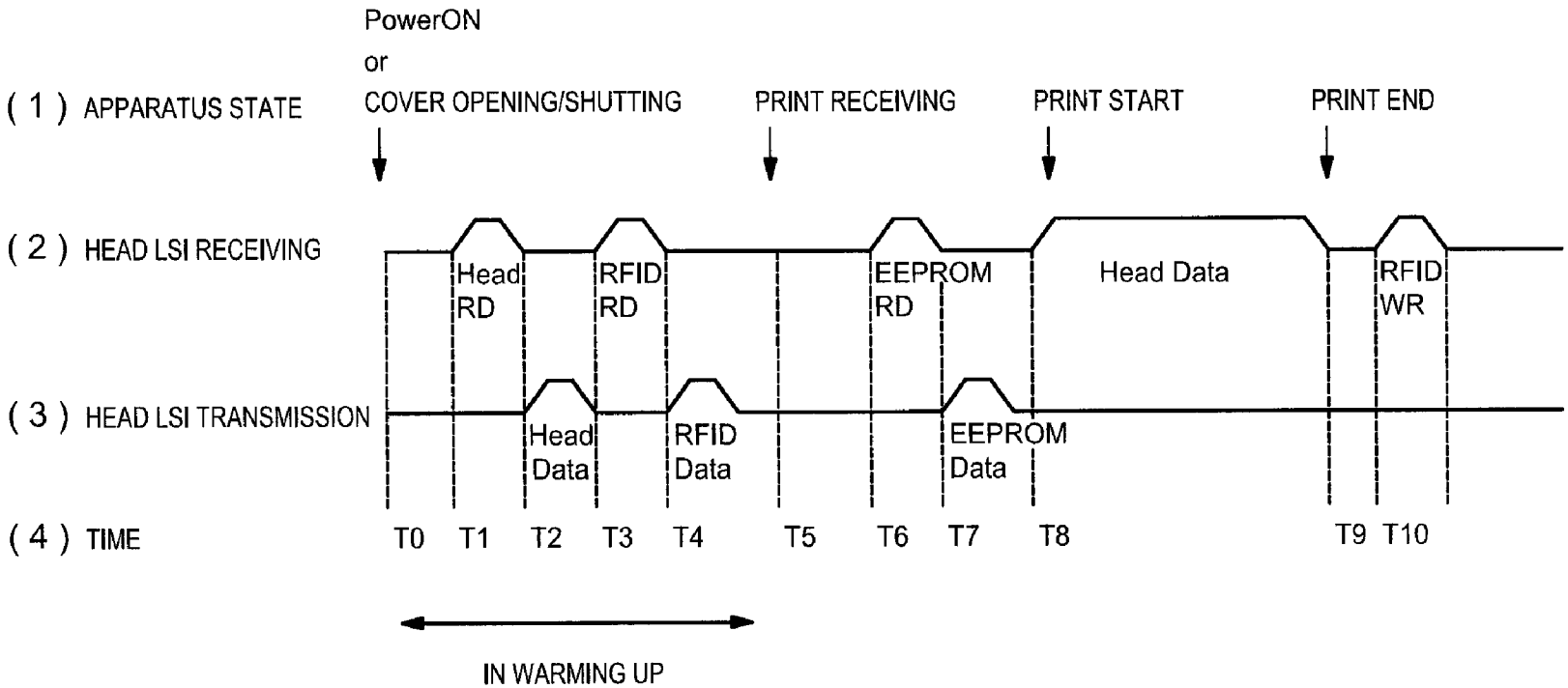
FIG. 10 is a time chart of image forming apparatus of embodiment 2.

FIG. 10 is a time chart of image forming apparatus of embodiment 2.

In the FIG. 10, from top to bottom, (1) apparatus state; (2) data received by Head LSI; (3) data sent by Head LSI; (4) time, are set and shown as items. Along a horizontal direction, a common time passage for respective items is shown.

The following is to perform an explanation for control method of image forming apparatus according to a time order together with FIG. 8.

Time T0:

When power source switch of image forming apparatus is turned on or in the case that the power source has been turned on, the upper cover 13 (FIG. 1) is shut.

Time T1:

The Head LSI 95Y receives Head RD command from the controlling system 90 via the LED head cable 98Y.

Time T2:

The Head LSI 95Y sends a Head Data (response) to the controlling system 90 via the LED head cable 98Y. The CPU 41 starts to continuously control the following when it is recognized that the response is normal.

Time T3:

The Head LSI 95Y receives a RFID RD command from the controlling system 90 via the LED head cable 98Y. The Head LSI 95Y analyzes the RFID RD command and controls the RFID unit 9Y to read out RFID information of the RFID tag 7Y.

Time T4:

The Head LSI 95Y sends RFID Data read out from the RFID tag 7Y to the controlling system 90 via the LED head cable 98Y.

Time T5:

The controlling system 90 starts to receive print data from an apparatus (not shown) above the controlling system 90. At that time, the Head LSI 95Y is standing by without operating.

Time T6:

The Head LSI 95Y receives EEPROM RD command from the controlling system 90 via the LED head cable 98Y. The Head LSI 95Y reads out dot correction information (EEPROM Data) from the EEPROM 96Y.

Time T7:

The Head LSI 95Y sends the dot correction information (EEPROM Data) read out from the EEPROM 96Y to the controlling system 90 via the LED head cable 98Y.

Time T8:

The Head LSI 95Y starts to receive Head Data from the controlling system 90 via the LED head cable 98Y. The Head Data obtained through the controlling system 90 corrects the print data received at time T5 from the upper apparatus on the basis of the dot correction information (EEPROM Data) received at time T7. At this time, the Head LSI 95Y starts to send the Head Data to the LED Driver 97Y. Therefore, a print is started.

Time T9:

The Head LSI 95Y no longer receives the Head Data from the controlling system 90 via the LED head cable 98Y. Therefore, print is ended.

Time T10:

The Head LSI 95Y receives RFID WR command and consumption part life information from the controlling system 90 via the LED head cable 98Y. The Head LSI 95Y writes the received consumption part life information into the RFID tag 7Y and ends operation.

As stated above, according to the embodiment, through furnishing the Head LSI 95 (Y, M, C, K) inside the LED head 110 (Y, M, C, K), it is possible to analyze command signals received/sent between the controlling system 90 and the LED head 110 (Y, M, C, K); and control conflict prevention of signals received/sent among the EEPROM 96 (Y, M, C, K), the RFID unit 9 (Y, M, C, K) and the LED Driver 97 (Y, M, C, K). So it is possible to only use one LED head cable 98 (Y, M, C, K) instead of the LED head cable 8 containing cables 45 and 46 in embodiment 1.

The utilization possibility in industry:

In the above stated explanation, only such case is explained that the present invention is applied to a color electronic printer of four colors. However, the present invention is not limited in this case. The present invention also can be applied to various devices such as monochrome printer, copying apparatus, facsimile apparatus, multiplex apparatus having two functions or over and the like. If only LED head and image forming unit exist, the present invention can be applied.

The present invention is not limited to the foregoing embodiments but many modifications and variations are possible within the spirit and scope of the appended claims of the invention.

What is claimed is:

1. An image forming apparatus including an attachable and removable exchange cartridge for accommodating toner and having a RFID tag, comprising:

an exposure head unit located proximate to the exchange cartridge; and a RFID unit located on the exposure head unit and performing radio communication with the RFID tag, wherein the RFID tag is located on a side wall of the exchange cartridge facing the RFID unit.

2. The image forming apparatus according to claim 1, further comprising:

a timing conflict preventing circuit that performs communication in a communication line for a control signal to control the RFID unit and an exposure signal sent to the exposure head unit, and prevents conflict in timings of two signals from occurring to control timings of the respective signals not to coincide.

3. The image forming apparatus according to claim 1, wherein the exposure head unit is located proximate a position deciding section located on the exchange cartridge, and the RFID unit is located proximate to the position deciding section.

4. The image forming apparatus according to claim 3, further comprising:

a timing conflict preventing circuit that performs communication in a communication line for a control signal to control the RFID unit and an exposure signal sent to the exposure head unit, and prevents conflict in timings of two signals from occurring to control timings of the respective signals not to coincide.

5. The image forming apparatus according to claim 1, wherein the exposure head unit is movable such that the exposure head unit moves together with the exchange cartridge.

6. The image forming apparatus according to claim 5, further comprising:

an elastic member, wherein the exposure head unit is located proximate to a position deciding section on the exchange cartridge, and the elastic member presses the exposure head unit toward the position deciding section.

7. An image forming apparatus including an attachable and removable exchange cartridge for accommodating toner and having a RFID tag, comprising:

a RFID unit communicating with the RFID tag through radio communication; and an exposure head unit, wherein the exposure head unit is movable such that the exposure head unit moves together with the exchange cartridge.

* * * * *